United States Patent [19]

Wilker

[11] Patent Number: 4,817,584

[45] Date of Patent: Apr. 4, 1989

[54] WOOD BURNING STOVE WITH CONCEALABLE DOORS

[75] Inventor: Allan S. Wilker, Brookfield, Vt.

[73] Assignee: Vermont Castings, Inc., Randolph, Mass.

[21] Appl. No.: 25,490

[22] Filed: Mar. 13, 1987

[51] Int. Cl.[4] ..... F24B 3/00; F23M 7/00

[52] U.S. Cl. ..... 126/66; 126/58; 126/190; 126/200

[58] Field of Search ..... 126/58, 64, 65, 66, 126/77, 85 R, 88, 89, 90 R, 120, 121, 138, 139, 190, 200, 140

[56] References Cited

U.S. PATENT DOCUMENTS

| | | | |
|---|---|---|---|
| 3,809,058 | 5/1974 | Becker | 126/120 |
| 4,167,177 | 9/1979 | Wiggins | 126/121 |
| 4,259,941 | 4/1981 | Gerdes | 126/120 |
| 4,467,778 | 8/1984 | Babbage et al. | 126/77 |

FOREIGN PATENT DOCUMENTS

| | | | |
|---|---|---|---|
| 987362 | 3/1965 | United Kingdom | 126/138 |

*Primary Examiner*—Margaret A. Focarino

*Attorney, Agent, or Firm*—Wolf, Greenfield & Sacks

[57] ABSTRACT

A freestanding wood, gas log or coal burning stove includes a pair of hinged glass or screen doors which are movable to storage compartments within the stove where they are completely concealed from view. In one embodiment, side panels are hinged to the stove frame assembly, and each door is hinged to one of the side panels in such a way that the door can be folded into a storage compartment between the stove frame assembly and the side panel. In another embodiment, fixed side panels define storage compartments between the side panel and the stove frame assembly, and each door slides into one of the storage compartments, In both embodiments, the storage compartment can include openings for circulation and heating of room air.

16 Claims, 5 Drawing Sheets

22
26
3
50
46
14
37
38
60
62
42
40
51
44b
58
54
44
44a
44c
48
32
24
28
4

Fig. 4
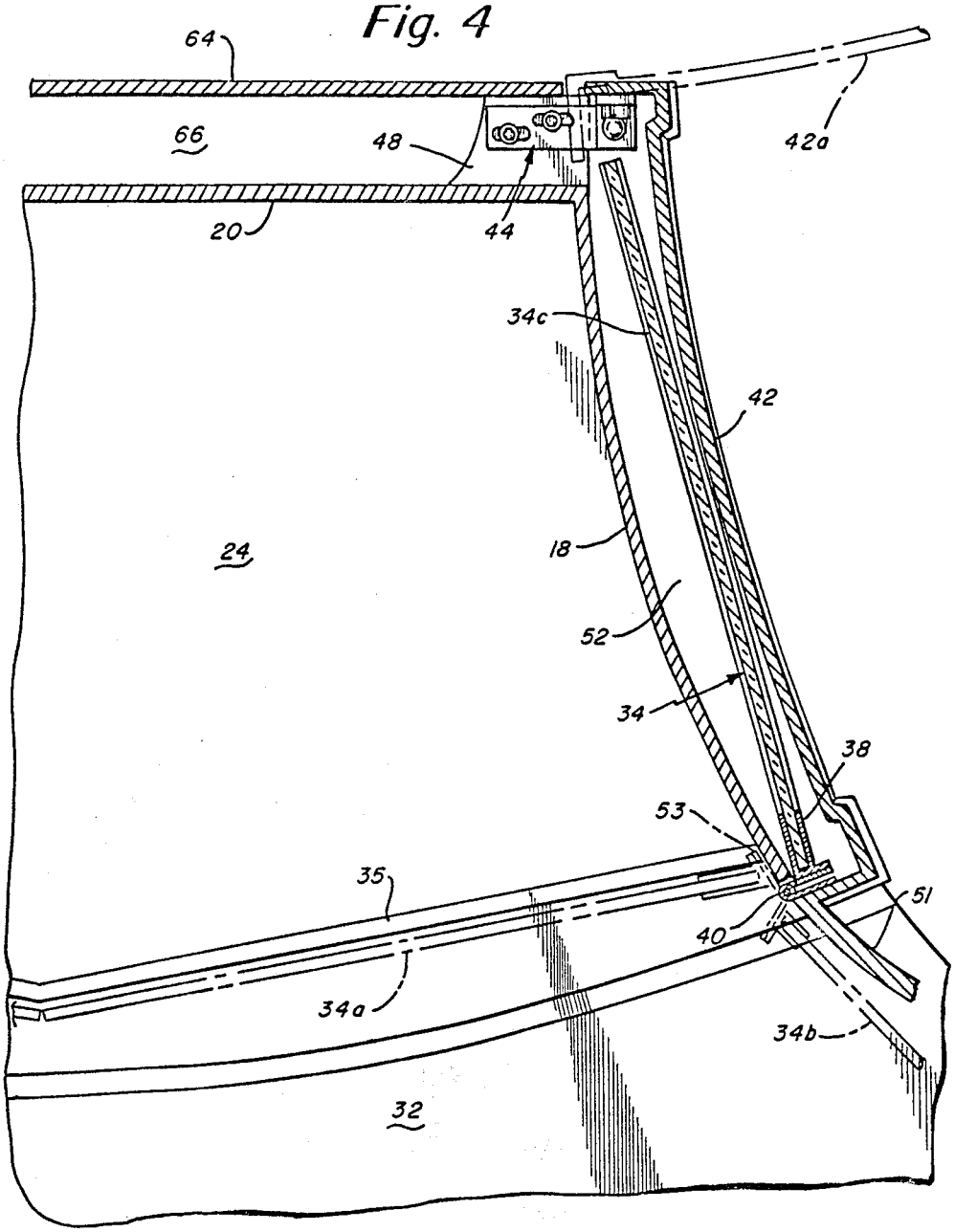
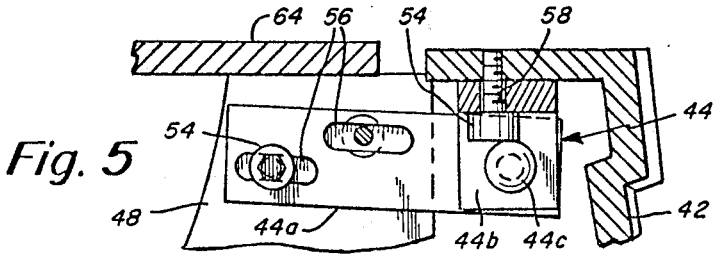
Fig. 5

WOOD BURNING STOVE WITH CONCEALABLE DOORS

FIELD OF THE INVENTION

This invention relates to the construction of wood, gas log and coal burning stoves and, more particularly, to stoves having hinged glass or screen doors which are completely concealed within storage compartments in the stove when they are not in use.

BACKGROUND OF THE INVENTION

Wood and coal burning stoves having one or more hinged doors for access through a front opening are well known. The doors may include glass or screen to permit viewing of the fire. A glass door permits viewing of the fire while limiting the flow of air into the combustion region and also prevents sparks from flying out of the stove. A screen door permits viewing and prevents sparks from flying out of the stove, but does not limit air flow. The doors are hinged for opening for loading of fuel into the stove, for tending of the fire, for removal of ashes and the like.

In some instances, it is desirable to leave the stove doors open to enjoy the full effect of an open fire. In previous stoves, the doors have simply been left in an open position in which they extend outwardly into the room. The open doors have an unattractive appearance and can create a hazard. The open doors can be tripped over or bumped against, causing the risk of personal injury, and the doors themselves can be damaged.

It is known in the case of built-in fireplaces to provide doors which slide out of sight into a wall. Such construction is not practical in the case of a freestanding stove.

It is a general object of the present invention to provide improved wood, gas log and coal burning stoves.

It is a further object of the present invention to provide wood, gas log and coal burning stoves having hinged doors which are completely concealed when not in use.

It is yet another object of the present invention to provide a freestanding stove having storage compartments for storage of hinged doors when they are not in use.

It is yet another object of the present invention to provide freestanding stoves which have an attractive appearance.

SUMMARY OF THE INVENTION

According to the present invention, these and other objects and advantages are achieved in a stove for burning wood, gas logs and coal comprising a combustion chamber defined by a frame assembly including front, side, rear, top and bottom walls, one of the walls having an opening for viewing of the combustion chamber and for access to the combustion chamber and door means including at least one vertically hinged door movable between a closed position in which it covers at least a part of the opening, an open position which permits access to the combustion chamber through the opening and a storage position within the stove when the door is not in use. The stove further includes door concealment means for retaining the door in the stored position so that it is completely concealed from view.

The opening is preferably located in the front wall of the frame assembly, and the door means preferably includes a pair of doors hinged at opposite sides of the frame assembly for covering the opening. In a preferred embodiment, the concealment means includes a side panel having front and rear edges and side panel hinge means pivotally connecting the side panel to the frame assembly for pivoting movement about a first vertical axis. The door means includes door hinge means pivotally connecting the door to the side panel for pivoting movement about a second vertical axis. The side panel is swung outwardly from the frame assembly about the first axis to permit movement of the door about the second axis to the storage position, and then the side panel is swung inwardly about the first axis to a position adjacent the frame assembly so as to define a storage compartment between the side panel and the frame assembly. The side panel hinge means can include means for adjusting the position of the side panel and the door to insure proper alignment between the door and the opening when the door is in its closed position. The stove can include means for retaining the side panel in position adjacent the frame assembly when the door is in the closed position.

In another preferred embodiment of the present invention, the door concealment means includes a side panel spaced from the frame assembly, and defining a storage compartment between the side panel and the frame assembly. The door is slidable into the storage compartment when it is not in use. The concealment means can further include track means mounted in the storage compartment for slidably receiving and guiding the door.

In either of the preferred embodiments, the doors are completely concealed in storage compartments within the stove when they are not in use. The doors can be at least in part glass or other transparent material, or screen. When the door is glass, a peripheral frame is provided around at least a portion of the door, and the door hinge means is attached to the peripheral frame.

The storage compartment defined between the side panel and the frame assembly can include openings near the upper and lower portions thereof to permit convection flow of air through the storage compartment. The air is heated as it flows through the storage compartment and then is circulated into the room.

BRIEF DESCRIPTION OF THE DRAWINGS

For a better understanding of the present invention together with other and further objects, advantages and capabilities thereof, reference is made to the accompanying drawings which are incorporated herein by reference and in which:

FIG. 4 is a partial cross-sectional plan view taken through line 4—4 of FIG. 2 showing the door and the storage compartment;

FIG. 5 is an enlarged fragmentary view of the hinge shown in FIG. 4;

DETAILED DESCRIPTION OF THE INVENTION

Figure 1:
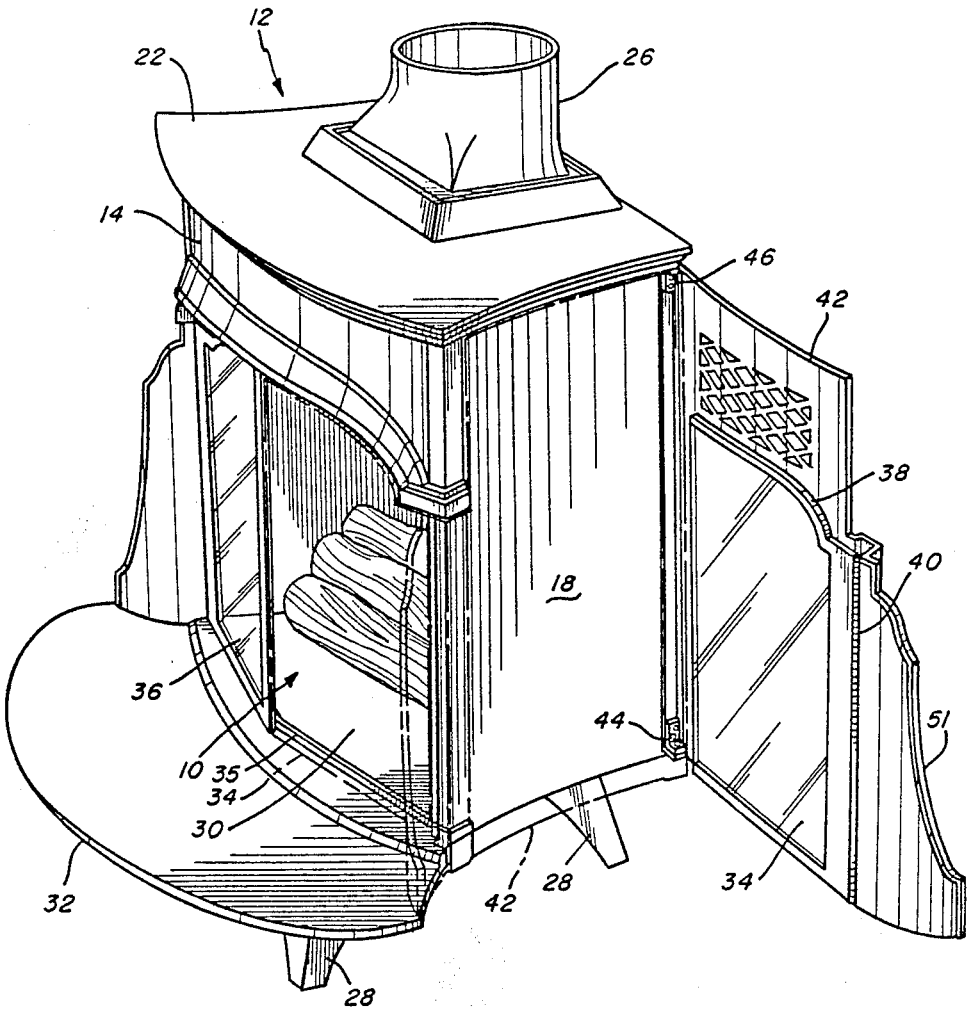
FIG. 1 is a perspective view of a stove in accordance with the present invention showing the right side panel swung out for storage of the door.
Figures 2, 3:
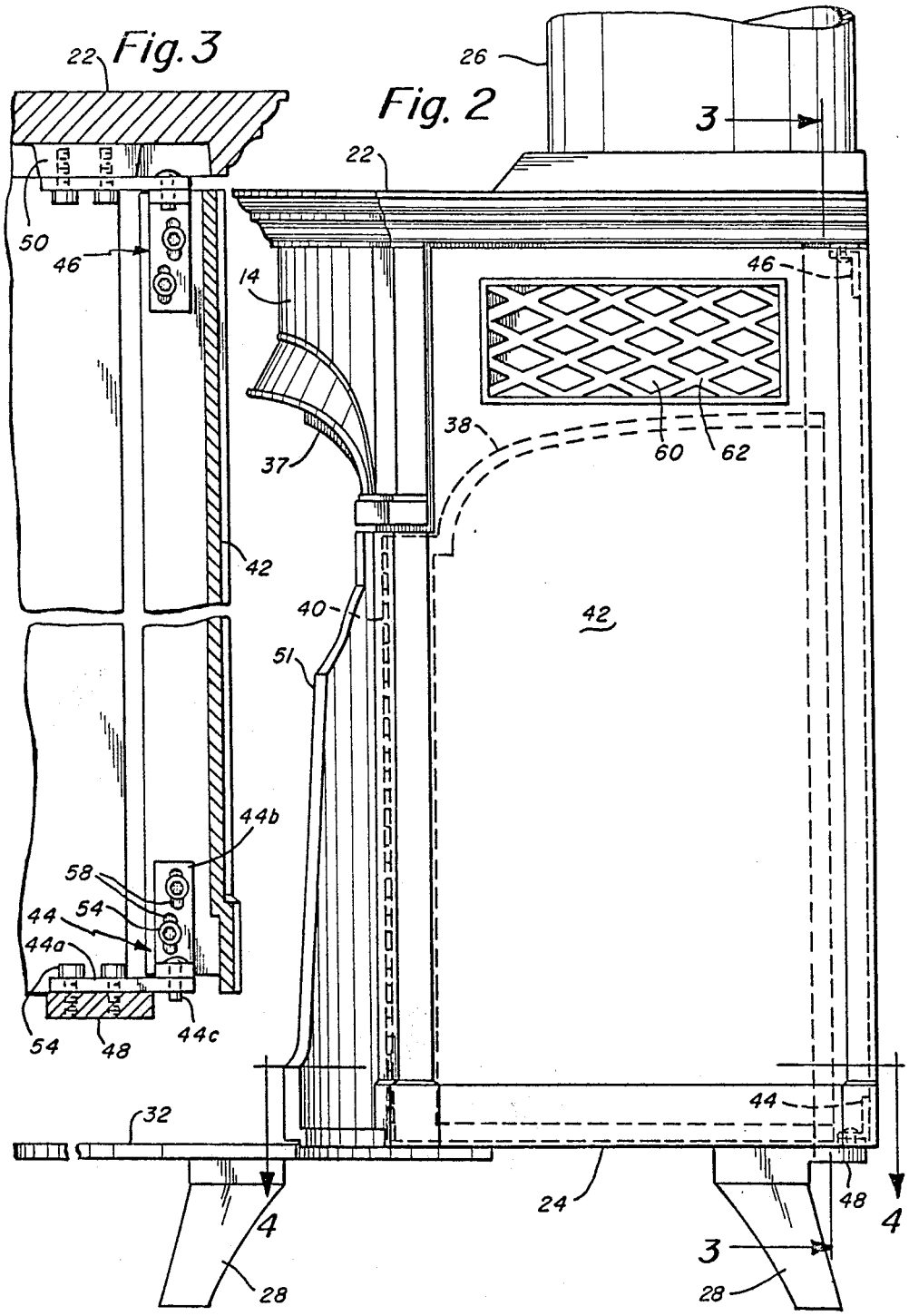
FIG. 2 is a right side elevation of the stove of FIG. 1 showing in phantom the door in its stored position.
FIG. 3 is a partial cross-sectional elevation taken through line 3—3 of FIG. 2 showing the side panel and hinges.

A freestanding stove in accordance with the present invention is shown in FIG. 1. A combustion chamber 10 which may be adapted for burning of wood, gas logs or coal is defined by a frame assembly 12 which includes a front wall 14, a left side wall (not shown), a right side wall 18, a rear wall 20 (FIG. 4), a top wall 22 and a bottom wall 24 (FIG. 2). An exhaust port in the top wall 22 is connected to a stovepipe 26. The frame assembly 12 further includes support legs 28.

Front wall 14 includes an opening 30 which permits viewing of a fire in the combustion chamber 10 and which permits access to the combustion chamber for loading of fuel, for tending of the fire and for removal of ashes. An ash lip 32 extends forwardly below the opening 30 to catch ashes, burning embers and sparks which may fly out of the combustion chamber 10.

The stove further includes a pair of vertically hinged doors 34, 36 movable between a closed position in which they cover the opening 30, an open position which permits access to the combustion chamber 10 through the opening 30 and a storage position in which the doors 34, 36 are completely concealed within the stove when they are not in use. The doors 34, 36 are hinged to pivot about vertical axes at opposite sides of the frame assembly 12 and, in the closed position meet each other at the center of the stove. The upper edge of opening 30 is provided with a curved contour for aesthetic reasons. A V-shaped bottom strip 35 and a generally arched, V-shaped top strip 37 provide stops for the doors 34, 36 when they reach the closed position. The doors 34, 36 can be latched in the closed position by conventional means, such as spring-loaded buttons (not shown) positioned below each door. The doors 34, 36 can be at least in part glass or other transparent material, or screen. Doors 34, 36 can be entirely glass or screen (except for frames, hinges and other hardware), or they can be provided with glass or screen panels in otherwise opaque doors. The stove is further provided with door concealment means for retaining each door 34, 36 in the storage position so that it is completely concealed from view in a storage compartment. The construction of the doors and the door concealment means is described in detail hereinafter.

A preferred embodiment of the door and door concealment means is illustrated in FIGS. 1–5 where like elements are indicated by the same reference numerals. As noted above, each of the hinged doors 34, 36 is movable between a closed position indicated in phantom at 34*a* in FIG. 4, an open position indicated in phantom at 34*b* in FIG. 4 and a stored position indicated at 34*c* in FIG. 4. In the case where the doors 34, 36 are glass, a peripheral frame 38, preferably of brass or steel, surrounds or partially surrounds the glass. The door 34 is connected by a piano hinge 40 to a side panel 42 for pivoting movement about a vertical axis defined by the hinge 40. Piano hinge 40 is connected to the front part of the side panel 42. The piano hinge 40 provides a reliable pivoting connection and limits warping of the parts to which it is connected.

The rear part of the side panel 42 is connected by a lower hinge assembly 44 and an upper hinge assembly 46 to the frame assembly 12 for pivoting movement about a vertical axis defined by hinge assemblies 44, 46. The lower hinge assembly 44 is connected to a projection 48 from bottom wall 24 of the frame assembly 12 near the intersection of side wall 18 and rear wall 20. Similarly, upper hinge assembly 46 is connected to a projection 50 from top wall 22 of frame assembly 12 near the intersection of side wall 18 and rear wall 20. As a result, the side panel 42 swings outwardly about an axis located near the rear corner of the stove to an open position as indicated at 42*a* in FIG. 4. When the side panel 42 is swung to a closed position adjacent the frame assembly 12, a storage compartment 52 (FIG. 4) is defined between side wall 18 and side panel 42. It will be understood that door 34 is hinged to side panel 42 and that door 36 is hinged to another side panel (not shown) symmetrical to side panel 42.

The side panel 42 includes a flap 51 which extends outwardly from its front portion and in the closed position, acts as a shield for the sides of opening 30 to block sparks flying from the combustion chamber. The flap 51 also can be utilized as a handle for side panel 42 when it is swung outwardly for storage of the door 34.

When the door 34 is in use, side panel 42 is in the closed position as shown in FIG. 4 and door 34 can be pivoted between the closed position 34*a* and the open position 34*b* as desired. When the door 34 is in closed position 34*a*, a portion 53 of hinge 40 abuts against side wall 18 and prevents side panel 42 from inadvertently swinging outwardly. In addition, the side panel 42 can be latched in the closed position by conventional means, such a formed leaf spring (not shown) mounted to the frame assembly 12 adjacent to the bottom of side panel 42.

When storage of the door 34 is desired, it is pivoted about hinge 40 to its open position 34*b*. Then side panel 42 is swung outwardly about hinge assemblies 44, 46 as indicated in FIG. 1, and door 34 is carried with it. Door 34 is then pivoted or folded inwardly about hinge 40 until it abuts or nearly abuts against the inside surface of side panel 42. Then side panel 42 is swung about hinge assemblies 44, 46 to the closed position adjacent the side wall 18 with door 34 now in its stored position in the storage compartment 52. In this configuration, door 34 is completely concealed from view within storage compartment 52. Door 36 is stored in the same manner in a storage compartment at the other side of the stove.

The construction of hinge assemblies 44, 46 is shown in FIGS. 3, 4 and 5. Lower hinge assembly 44 includes a hinge plate 44*a* connected by bolts 54 to projection 48, an L-shaped hinge plate 44*b* connected by bolts 54 to side panel 42 and a pivot pin 44*c* passing through aligned holes in hinge plates 44*a*, 44*b* and defining the pivot axis of side panel 42. Hinge assembly 46 utilizes the same construction and will not be described in detail. Hinge plate 44*a* includes elongated mounting holes 56 which permit side panel 42 to be adjusted inwardly or outwardly before bolts 54 are tightened. The holes 56, in addition, are wider than the diameter of bolts 54 so that side panel 42 can be moved forwardly or rearwardly to some extent prior to tightening of bolts 54. Similarly, hinge plate 44*b* contains elongated mounting holes 58 which permit side panel 42 to be adjusted upwardly or downwardly prior to tightening of bolts 54.

As a result of the construction of hinge assemblies 44, 46, side panel 42 can be adjusted in any direction, thereby insuring that door 34 can be adjusted into alignment with opening 30. The adjustment is desirable because of tolerances in the dimensions of side panel 42 which is typically cast iron, dimensional variations due to heating and aging and any other factors which may cause door 34 to become misaligned with opening 30. It is to be understood that the hinge assemblies 44, 46 are but one example of a hinge construction which may be utilized for connecting side panel 42 to frame assembly 12 and for permitting adjustment of the relative position of side panel 42.

The lower end of storage compartment 52 defined between side panel 42 and side wall 18 is open. The upper portion of side panel 42 is provided with an opening 60 covered with a grille 62. The open bottom of storage compartment 52, and opening 60 at the upper end thereof, permit air to circulate through storage compartment 52 by convection and to be heated as it passes along hot side wall 18. The heated air then circulates into the room. This configuration promotes convection heating and reduces the exterior temperature of the stove, thereby permitting it to be located closer to combustible surfaces than would otherwise be possible. The rear of the stove uses a similar construction wherein fixed rear panel 64 is spaced from rear wall 20, thereby defining a convection space 66.

Figure 6:
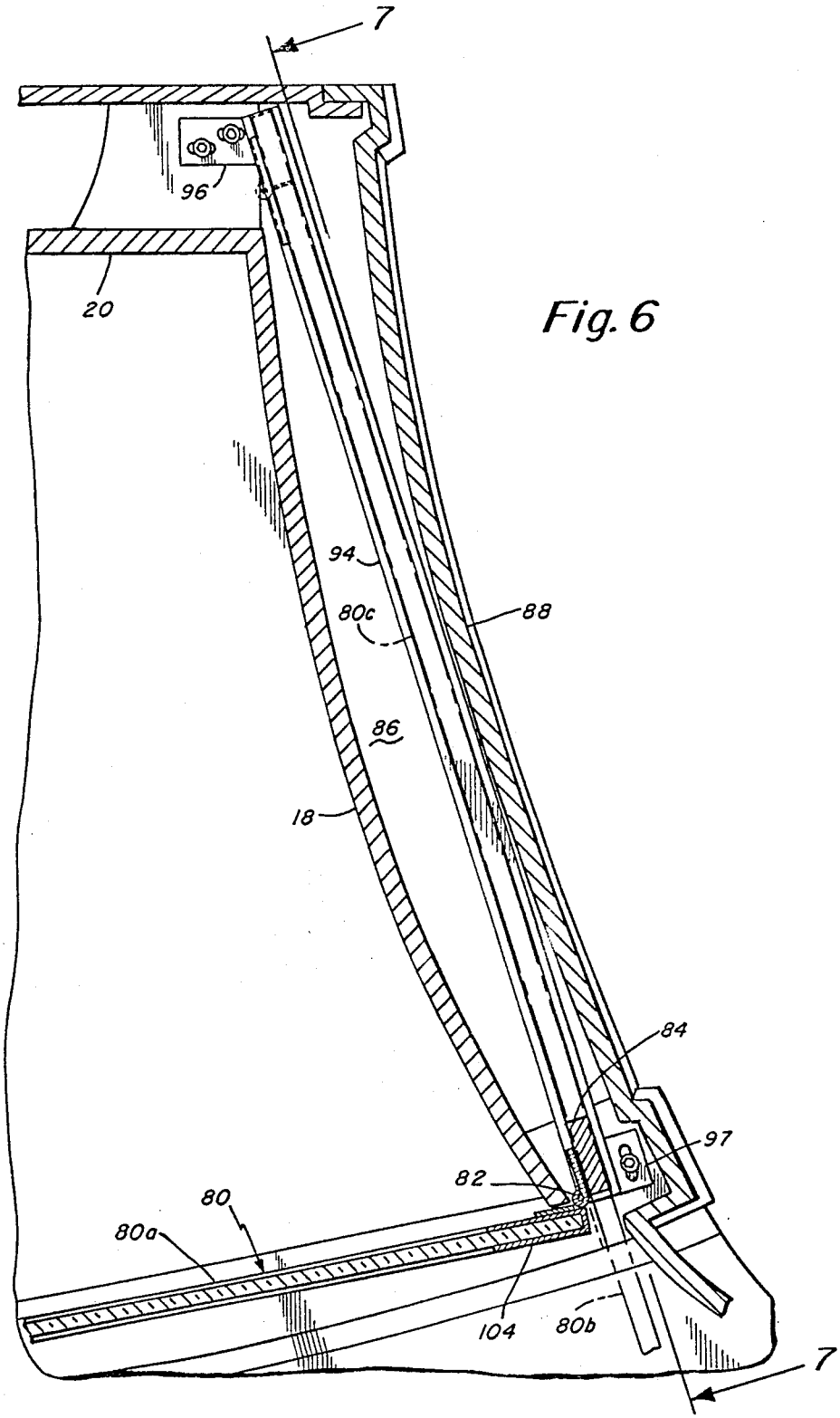
FIG. 6 is a partial cross-sectional elevation of the stove in accordance with another embodiment of the present invention.
Figure 7:
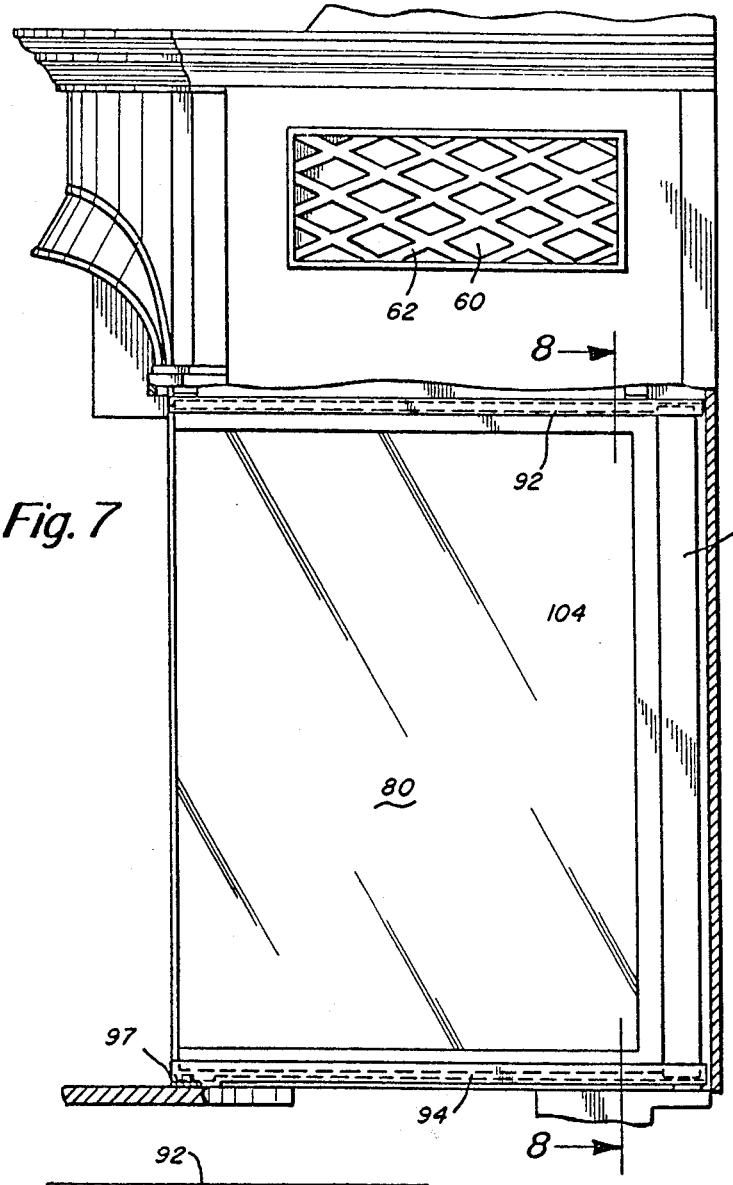
FIG. 7 is a side elevation partly in cross-section, taken through the line 7—7 of FIG. 6 showing the door in the storage compartment.
Figure 8:
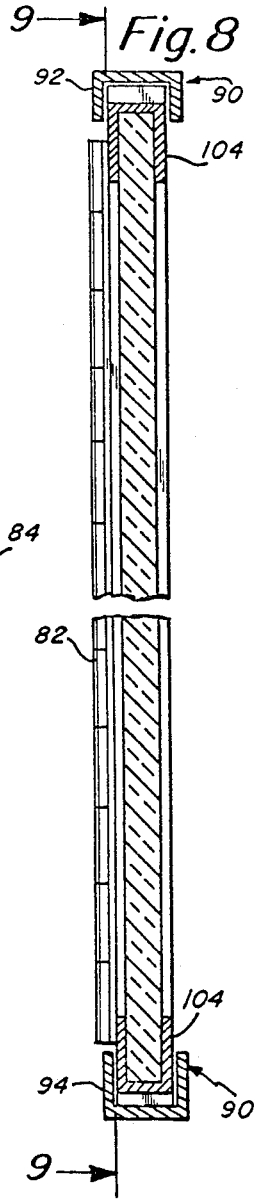
FIG. 8 is a cross-sectional elevation of the stored door taken through the line 8—8 of FIG. 7.

Another preferred embodiment of the present invention is shown in FIGS. 6–9. In this embodiment, the stove doors slide into a storage position instead of swinging to a storage position. The configuration of the stove in this embodiment is generally similar to that shown in FIG. 1 except for the construction of the doors and the door concealment means. Referring to FIG. 6, the door and door concealment means are shown in cross-sectional plan view. The side wall 18 and the rear wall 20 are as described above in connection with FIG. 1. A door 80 is connected by a piano hinge 82 to a vertical support strip 84 for pivoting around a vertical axis defined by hinge 82. Door 80 is movable between a closed position **80*a* in which it covers a portion of the front opening 30 of the stove, an open position 80*b* indicated in phantom, which permits access to the combustion chamber 10, and a storage position 80*c* indicated in phantom. In the storage position 80*c*, the door 80 is completely concealed from view in a storage compartment 86 defined by a side panel 88 and side wall 18. The side wall 18 and side panel 88 are spaced by a sufficient distance to permit the door 80 to slide between them into the storage compartment 86. In the embodiment of FIGS. 6–8, the side panel 88 is fixed in position since the swinging motion of the door to the storage position is not required. The storage compartment 86 contains a track 90 comprising an upper channel 92 and a lower channel 94 mounted to the frame assembly with brackets 96, 97 and retaining the upper and lower edges of the door 80**.

To move the door 80 to the storage position, it is first pivoted outwardly to the open position **80*b* and then is pushed rearwardly so that it slides along the track 90 into the storage compartment 86. The vertical support strip 84 and the hinge 82 slide with the door 80 into the storage compartment 86. The door 80 is shown in the storage position in FIG. 7. A handle (not shown) can be provided at the front edge of the door 80**, if desired, to facilitate movement of the door to the storage position.

Figure 9:
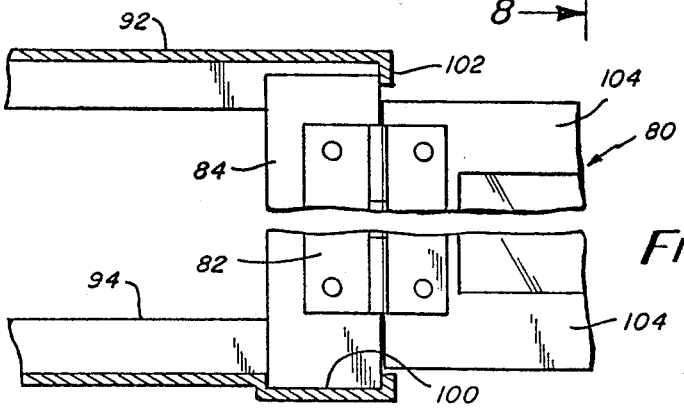
FIG. 9 is a fragmentary view, partly in cross-section, of the door and track along the line 9—9 of FIG. 8.

The detail of FIG. 9 illustrates construction of the front ends of the upper channel 92 and the lower channel 94 to maintain the support strip 84 in a vertical position when the door 80 is not in the storage position. The lower channel 94 includes a recess 100 at its front end for receiving the lower end of the support strip 84, and the upper channel 92 includes at its front end a downwardly extending lip 102. The recess 100 and the lip 102 prevent the door 80 and the support strip 84 from tilting due to the weight of the door 80.

As described above, the door 80 can be at least in part glass or other transparent material in which case it is surrounded or partially surrounded by a peripheral frame 104 to which the piano hinge 82 is attached. Alternatively, the door 80 can at least in part comprise a screen. Door 80 can be entirely glass or screen (except for a frame, hinges and other hardware), or it can be provided with a glass or screen panel in an otherwise opaque door. The embodiment of FIGS. 6–9 is preferably constructed with the bottom of the storage compartment 86 between side wall 18 and side panel 88 open and with the upper portion of side panel 88 having opening 60 with grille 62 mounted therein. As described above, this permits air to flow through storage compartment 52 by convection and to be heated as it passes side wall 18.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A stove for burning solid fuels or gas logs comprising:

a combustion chamber defined by a frame assembly including front, side, rear, top and bottom walls, one of said walls having an opening for viewing of the combustion chamber and for access to the combustion chamber;

door means including at least one vertically hinged door movable between a closed position in which it covers at least a part of said opening, an open position which permits access to said combustion chamber through said opening and a concealed storage position; and door concealment means coupled to said frame assembly for retaining said door in the storage position so that it is completely concealed from view, said door concealment means including a side panel hinged to said frame assembly, said door means being hinged to said side panel, and a storage compartment for said door means being defined between said side panel and said frame assembly.

2. A stove as defined in claim 1 wherein said opening is located in the front wall of said frame assembly and wherein said door means includes a pair of hinged doors for covering said opening.

3. A stove for burning solid fuels or gas logs comprising:

a combustion chamber defined by a frame assembly including front, side, rear, top and bottom walls, one of said walls having an opening for viewing of the combustion chamber and for access to the combustion chamber;

door means including at least one vertically hinged door movable between a closed position in which it covers at least a part of said opening, an open position which permits access to said combustion chamber through said opening and a concealed storage position; and door concealment means coupled to said frame assembly for retaining said door in the storage position so that it is completely concealed from view, said door concealment means including a side panel having front and rear edges, and side panel hinge means pivotally connecting said side panel to said frame assembly for pivoting movement about a first vertical axis and wherein said door means includes door hinge means pivotally connecting said door to said side panel for pivoting movement about a second vertical axis, said side panel being swung outwardly from said frame assembly about the first axis to permit movement of said door about the second axis to the storage position, said side panel then being swung inwardly about the first axis to a position adjacent said frame assembly so as to define a storage compartment between said side panel and said frame assembly.

4. A stove as defined in claim 3 wherein said side panel hinge means includes means for adjusting the position of said side panel and said door upwardly or downwardly, forwardly or rearwardly, and left or right, relative to said frame assembly to insure proper alignment between said door and said opening when said door is in its closed position.

5. A stove as defined in claim 4 further including means for retaining said side panel in position when said door is in the closed position.

6. A stove as defined in claim 5 wherein said retaining means comprises said door hinge means having a portion which abuts against said frame assembly when said door is in the closed position.

7. A stove for burning solid fuels or gas logs comprising:

a combustion chamber defined by a frame assembly including front, side, rear, top and bottom walls, one of said walls having an opening for viewing of the combustion chamber and for access to the combustion chamber;

door means including at least one vertically hinged door movable between a closed position in which it covers at least a part of said opening, an open position which permits access to said combustion chamber through said opening and a concealed storage position; and door concealment means coupled to said frame assembly for retaining said door in the storage position so that it is completely concealed from view, said door concealment means including a side panel spaced from said frame assembly and defining a storage compartment between said side panel and said frame assembly, said door being slidable into said storage compartment when not in use, said concealment means further including track means mounted in said storage compartment for slidably receiving said door.

8. A stove as defined in one of claims 1–3 or 7 wherein said door is at least in part glass.

9. A stove as defined in one of claims 1–3 or 7 wherein said door is at least in part a screen.

10. A stove as defined in one of claims 1–3 or 7 wherein said storage compartment defined between said side panel and said frame assembly includes openings near the upper and lower portions thereof for convection flow of air through said storage compartment, the air being heated as it flows through said storage compartment.

11. A stove as defined in claim 8 further including a peripheral frame around at least a portion of said glass door, said door hinge means being attached to said peripheral frame.

12. A stove as defined in claim 7 wherein said door is hinged to a support strip for pivoting movement between said open position and said closed position, said door and said support strip being slidable in said track means to and from said storage position.

13. A stove for burning solid fuels or gas logs comprising:

a combustion chamber defined by a frame assembly including front, side, rear top and bottom walls, said front wall having an opening for viewing of the combustion chamber and for access to the combustion chamber;

a pair of hinged doors which pivot about vertical axes and together cover said opening when in a closed position, each hinged door being movable between the closed position, an open position which permits access to the combustion chamber through said opening and a concealed storage position; and door concealment means coupled to said frame assembly for retaining each hinged door in its storage position so that it is completely concealed from view, said door concealment means including a pair of concealment panels hinged to said frame assembly, said doors being hinged to said concealment panels, respectively.

14. A stove for burning solid fuels or gas logs comprising:

a combustion chamber defined by a frame assembly including front, side, rear, top and bottom walls, said front wall having an opening for viewing of the combustion chamber and for access to the combustion chamber;

a pair of hinged doors which pivot about vertical axes and together cover said opening when in a closed position, each hinged door being movable between the closed position, an open position which permits access to the combustion chamber through said opening and a concealed storage position; and door concealment means coupled to said frame assembly for retaining each hinged door in its storage position so that it is completely concealed from view, said door concealment means including a side panel assembly associated with each hinged door, each side panel assembly including a side panel and side panel hinges pivotally connecting the side panel to the frame assembly for pivoting movement about a first vertical axis, each hinged door including a door hinge pivotally connecting said hinged door to the associated side panel for pivoting movement about a second vertical axis, each side panel being movable outwardly from said frame assembly about said first axis to permit movement of said door about said second axis to the storage position, said side panel then being movable inwardly about said first axis so as to enclose said door in a storage compartment between said side panel and said frame assembly.

15. A stove for burning solid fuels or gas logs comprising:

a combustion chamber defined by a frame assembly including front, side, rear, top and bottom walls, said front wall having an opening for viewing of the combustion chamber and for access to the combustion chamber;

a pair of hinged doors which pivot about vertical axes and together cover said opening when in a closed position, each hinged door being movable between the closed position, an open position which permits access to the combustion chamber through said opening and a concealed storage position; and door concealment means coupled to said frame assembly for retaining each hinged door in its storage position so that it is completely concealed from view, said door concealment means including a pair of side panels spaced from opposite sides of said frame assembly and defining storage compartments between said side panels and said frame assembly, each door being slidable into one of said storage compartments when not in use.

16. A stove as defined in claim 15 wherein said door concealment means further includes track means in each of said storage compartments and wherein each of said doors is hinged to a support strip for pivoting movement between said open position and said closed position, each door and support strip being slidable in the respective track means to and from said storage position.

* * * * *